United States Patent [19]

Han

[11] 4,196,343

[45] Apr. 1, 1980

[54] HAIR DRYER

[75] Inventor: Paul S. Han, Foster City, Calif.

[73] Assignee: C.A.H., Inc., San Mateo, Calif.

[21] Appl. No.: 882,711

[22] Filed: Mar. 2, 1978

[51] Int. Cl.[2] ..... A45D 20/00

[52] U.S. Cl. ..... 219/364; 219/370; 200/157

[58] Field of Search ..... 219/361, 363, 364, 367, 219/369, 370, 373, 374, 379, 240, 241; 34/96–98, 243; 132/9, 11 R, 32; 200/153 P, 153 PA, 157; 128/254–257; 338/198–200, 202, 184, 162, 172

[56] References Cited

U.S. PATENT DOCUMENTS

| | | | |
|---|---|---|---|
| 1,940,506 | 12/1933 | Peck | 219/373 |
| 3,593,001 | 7/1971 | Simpson et al. | 219/241 |
| 3,890,984 | 6/1975 | Lesetar | 139/9 |
| 3,911,934 | 10/1975 | Helbling | 219/364 |
| 4,003,388 | 1/1977 | Nopanen | 219/370 |

FOREIGN PATENT DOCUMENTS

| | | | |
|---|---|---|---|
| 124748 | 4/1949 | Sweden | 200/153 P |
| 647291 | 12/1950 | United Kingdom | 219/364 |
| 1439056 | 6/1976 | United Kingdom | 132/9 |

*Primary Examiner*—Bruce A. Reynolds
*Assistant Examiner*—Bernard Roskoski
*Attorney, Agent, or Firm*—Townsend and Townsend

[57] ABSTRACT

A hair dryer of the hand-held variety has infinitely variable temperature and fan speed control. The fan speed control is trigger operated by the index finger while the heat control is thumbwheel actuated by the thumb. Neither control, once set, requires any further action such as holding in place to maintain the desired setting. By location of the controls in this fashion, surprisingly easy and efficient one-handed overall control of the hair dryer is possible.

3 Claims, 4 Drawing Figures

HAIR DRYER

BACKGROUND OF THE INVENTION

Hand held hair dryers wherein a jet of warm air is directed towards the user's head are known. A typical unit has separate temperature and fan speed controls, consisting of toggle switches located on the handle of the dryer, thereby offering the user a few discrete settings. The user will typically select a combination of temperature and fan speed before using the dryer, since the switches on the handle are not easily controlled while the hair dryer is in use.

When a person uses the dryer to dry his own hair, a change of setting will normally require that the hair dryer be directed away from the hair and brought to a location where the user can see the switches that he is throwing. When the user is drying the hair of another, a change of setting will typically require the use of the hand not holding the dryer to effect the change. Since that hand is normally used to manipulate a hairbrush or similar device, having to use that hand to change the setting is at best an inconvenience.

In addition to use for drying hair, hair dryers are often used in other applications where a directed stream of warm or hot air is required. Some of these applications, such as speeding up the curing of epoxy resin, require a rather precise temperature control, normally not available with a hair dryer of the conventional type wherein only discrete settings are available.

Accordingly, the object of the present invention is to provide a hair dryer with infinitely variable fan speed and heater current controls that can easily be manipulated with one hand and without looking.

SUMMARY OF THE INVENTION

A hair dryer is provided wherein the air stream temperature and blower speed are independently controlled and continuously variable within their extreme limits. Circuitry is disclosed to provide these smooth controls.

The hair dryer of the present invention has an overall pistol-shaped configuration. The heater current, and hence the temperature of the air stream, is controlled by a first potentiometer which is adjusted by a thumbwheel above and behind the handle so as to be easily reached by the user's thumb when the dryer is being held in its normal way. The motor current and hence the blower speed is controlled by a second potentiometer which is connected by gearing to a finger-actuated trigger located as as to be easily reached by the user's index finger when the hair dryer is being held in its normal way. Thus each potentiometer provides continuously variable control of its respective current between its extreme limits. The hair dryer is provided with an on/off switch which controls both the heater and the motor circuits, and is actuated by the trigger near the beginning of its travel in the low blower speed region.

The trigger is not spring-loaded, so that the user, once having arrived at a satisfactory setting, need not maintain any pressure on the trigger. A trigger guard surrounding the trigger allows the user, once having selected a blower speed, to use the hair dryer without fear that the speed will be changed inadvertently. The location of the thumbwheel that controls the air stream temperature is located just far enough away from the normal position of the user's thumb so that inadvertent changes in setting cannot occur.

At the same time, however, the controls are easily reached by the user's thumb and forefinger without the user's having to look at the dryer or significantly change his hand position on the handle. Moreover, the hand that is not holding the dryer is left entirely free to manipulate a hair brush or similar device uniterruptably, even when the controls are being operated.

DESCRIPTION OF THE PREFERRED EMBODIMENT

Figure 1:
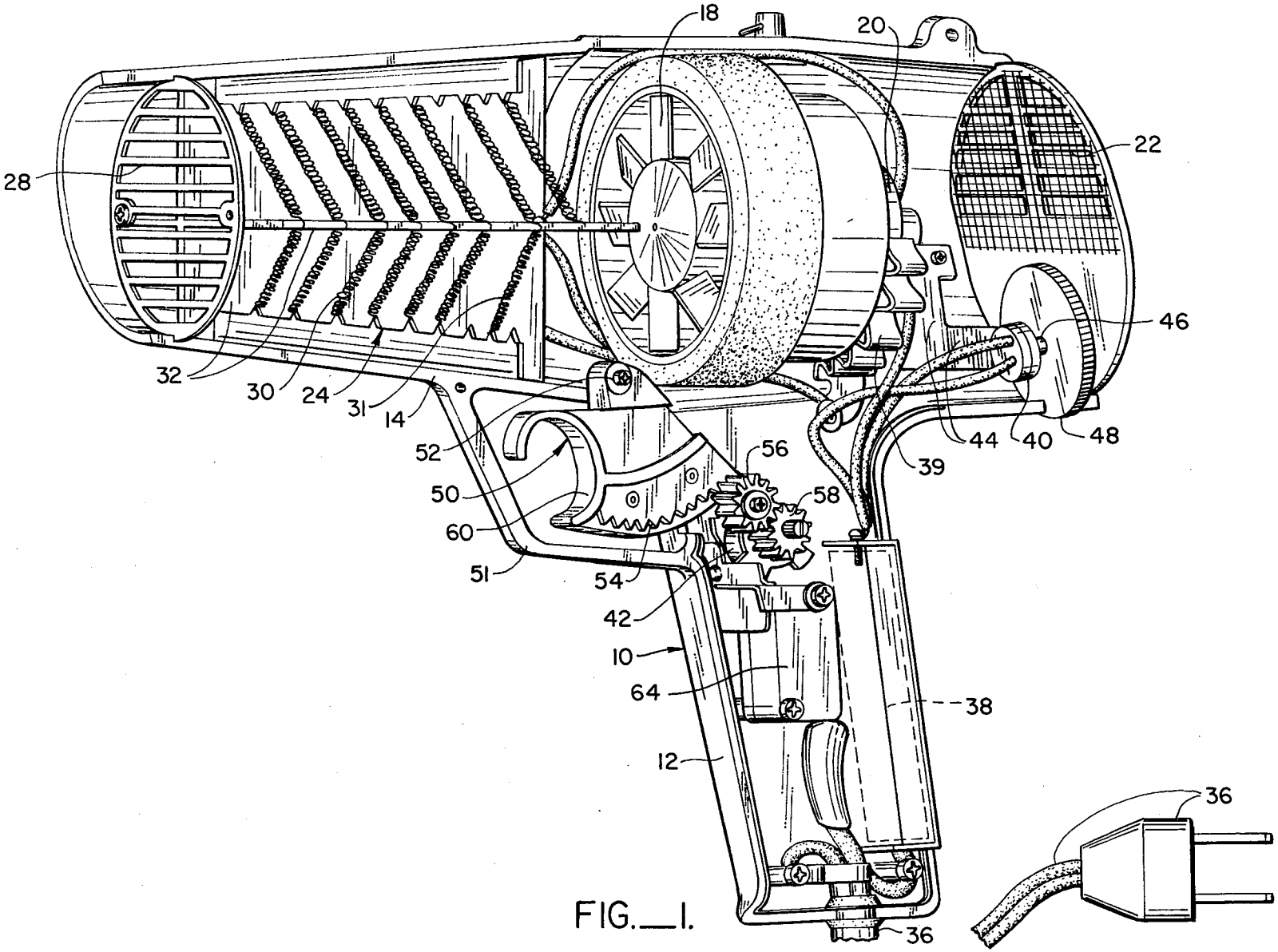
FIG. 1 is a perspective view of the hair dryer with a portion of the housing removed to show the major components and the control features of the present invention.

A hand held hair dryer has an outer plastic shell 10 having a handle portion 12 and a barrel portion 14. Shell 10 is preferably cast as two separate, symmetric halves to provide for attachment of the internal components to a first half, and subsequent placement thereon and bolting thereto of a second half. FIG. 1 is drawn with the second half removed. A fan 18 driven by motor 20 draws cool air through air intake 22 at the rear of the barrel and blows it forward over heater 24, exhausting it though nozzle 28. For convenience, nozzle 28 will hereinafter be considered to be forward of air intake 22. Additional air intakes may be provided in the side of the barrel, immediately ahead of intake 22. Heater 24 consists of coiled resistance wire 30 supporting on a mica or other heat resistant frame 32. A separate portion of coiled resistance wire 31 serves as a motor voltage dropping resistor. Electric power for the fan motor and the heater element is provided through line cord and plug 36. Most of the controlling electronics for both the motor and the heater are situated in handle 12 in the region generally designated by phantom outline 38. Circuitry, the operation of which is described below, makes use of potentiometer 42 to control the fan speed. Convolute sheet metal strip 39 is a heat sink to which one or more of the circuit's semiconductor devices could be mounted.

Potentiometer 40 is attached to the plastic shell by means of bracket 44 so that its shaft 46 extends backwards toward air intake 22. Thumbwheel 48 is fixed on shaft 46, and the thumbwheel is sized and the bracket is positioned so that a portion of the thumbwheel's circumference extends below the general confines of outer shell 10 behind handle 12. The location of the thumbwheel 48 is chosen so that the thumbwheel is sufficiently close to handle 12 to allow a user holding the hair dryer to readily reach the thumbwheel with his thumb without significantly altering his grip on the hair dryer. However, it should be noted that the thumbwheel is positioned to require the user to raise his thumb to turn the thumbwheel. Accordingly, inadvertent adjustment is unlikely to occur.

Potentiometer 42 is controlled by trigger 50. Trigger 50, pivoted about a stud 52, has an arcuate gear rack 54 of relatively large diameter with its center of curvature substantially at stud 52. Rack 54 engages with idler gear 56 and pinion 58. Pinion 58 is mounted on the shaft of potentiometer 42. The body of trigger 50 has at its front the finger engaging portion 60 to allow the user to pivot trigger 50 about stud 52. The trigger is located and sized in such a manner that a user holding the hair dryer can esily extend his index finger to pivot the trigger about stud 52 without significantly altering his grip on the hair dryer. Finger engaging portion 60 extends at least partially around a finger placed thereto, to allow the user to move the trigger in either direction. Trigger 50 is not spring-loaded, so once a user has found a satisfactory setting, the setting is maintained. Trigger guard 51 surrounds the front part of trigger 50 to prevent accidental changes in setting.

Figure 2A:
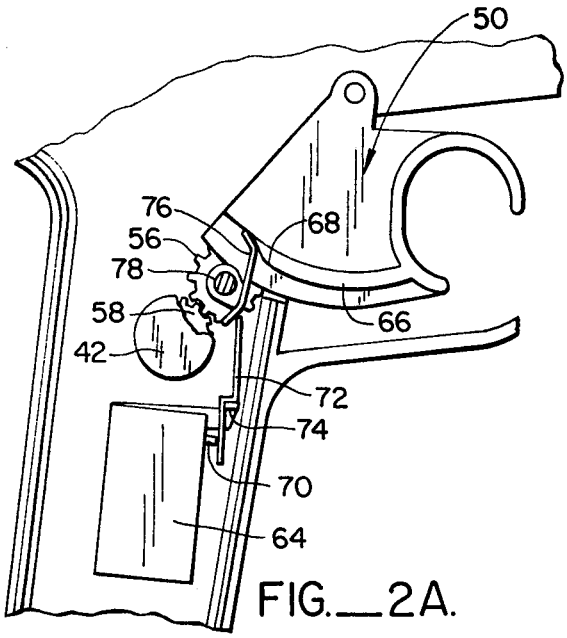
FIG. 2*a* is a cutaway view showing the trigger in the "off" position.
Figure 2B:
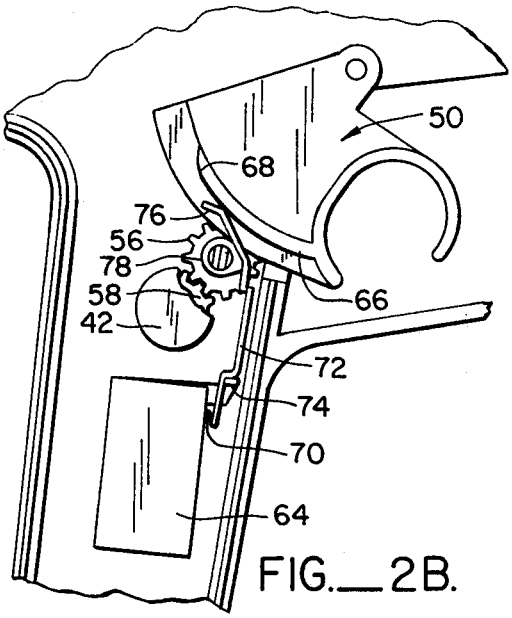
FIG. 2*b* is a cutaway view showing the trigger in the "on" position.

FIGS. 2*a* and 2*b* show how trigger 50 also actuates on/off switch 64 which controls electrical power to both the motor and heater. The side of trigger 50 opposite that having gear teeth 54 has a raised partial annular segment 66 terminating in a cam element 68. On/off switch 64 has a protruding plunger 70, spring loaded outwardly to the switch's "off" position. Plunger 70 confronts level 72, a small sheet metal member that pivots about the edge of protruding member 74 against which it rests. Motion of the trigger is transmitted to lever 72 via a second lever 76 pivoted about point 78. In practice, point 78 is also the center about which idler gear 56 rotates.

FIG. 2*a* shows trigger 50 in its forward position. Neither cam element 68 nor annular segment 66 bears against lever 76. Accordingly, lever 76 does not bear against lever 72, thus allowing plunger 70 on switch 64 to remain out.

As trigger 50 is pulled back, cam element 68 engages lever 76, causing it to rotate and bear against lever 72 which forces plunger 70 in. As can be seen from FIG. 2*b*, any further pull on trigger 50 has annular segment 66 continuing to bear against lever 76, but leaving its position unchanged. Thus plunger 70 is held in.

The location of cam 68 relative to annular segment 66 is such that switch 64 is turned on with only a short pull of the trigger, with the remainder of the trigger's pull being available for control of potentiometer 42.

Figure 3:
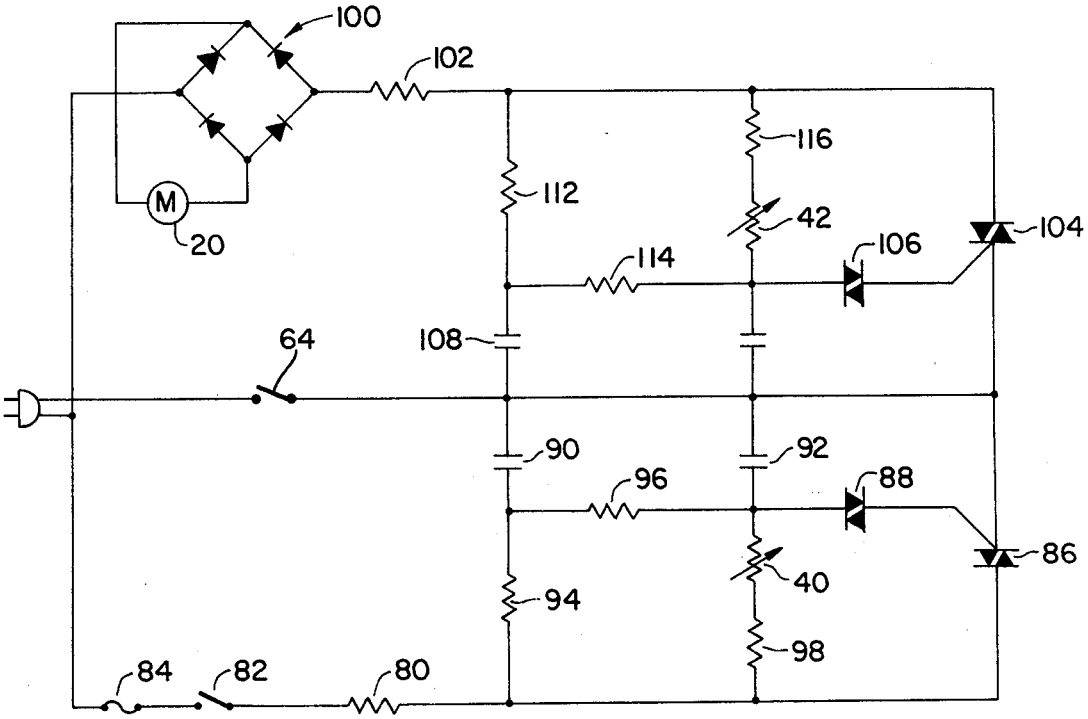
FIG. 3 is a schematic of a typical circuit for providing independent and infinitely variable control for the fan speed and heater temperature of the hair dryer.

FIG. 3 is a schematic of a typical thyristor power control circuit that can be used to control the motor speed and the heater temperature. Such sircuitry is well known in the art, being very similar to a circuit disclosed at page 487 of the RCA Solid State Devices Manual (1975 edition).

1000 watt main heater element 80 (corresponding to wire coils 30) is connected in series with 120° C. thermostat 82° and 149° C. temperature fuse 84. Current through this path is controlled by 400 Volt, 15 amp TRIAC 86 the gate of which is connected to DIAC 88. 0.1 microfarad 400 volt capacitor 90 and 0.1 microfarad 50 volt capacitor 92 are charged through 56K resistor 94, 47K resistor 96, 4.7K resistor 98 and 100K variable resistor (potentiometer) 40. Depending on the setting of potentiometer 40, the rate at which capacitor 92 is charged is varied, thereby varying the point in the AC cycle when DIAC 80 breaks down, triggering TRIAC 86. In this fashion, current to heater element 80 is controlled by changing the setting of potentiometer 40. DIAC 88 and TRIAC 86 allow current flow and control on both the positive and negative parts of the AC cycle.

12 volt 1.1 amp DC motor 20, shown connected across diode bridge 100 is connected in series with 250 watt heater element 102 (corresponding to wire coils 31) which also serves as a motor voltage drop resistor. Current through this leg of the circuit is controlled in a manner analogous to that through the main heater leg. The gate of 200 volt 3 amp TRIAC 104 is connected in series with DIAC 106. 0.2 microfarad 400 volt capacitor 108 and 0.1 microfarad 50 volt capacitor 110 are charged through 56K resistor 112, 47K resistor 114, 56K resistor 116, and 100K potentiometer 42. Depending on the setting of potentiometer 42, the rate at which capacitor 110 is charged is varied, thereby varying the point in the AC cycle when DIAC 106 breaks down triggering TRIAC 104. In this way, motor current is controlled by varying potentiometer 42.

I claim:

1. In a hand held dryer having a motor, a fan driven by said motor, means for providing electrical current to said motor, a heater, means for providing electrical current to said heater, a barrel, and a handle, wherein said current to said motor causes said motor to drive said fan, causing a stream of air to be blown through said barrel, wherein said current to said heater causes said stream of air to be heated, and wherein a user holds said handle in order to direct said stream of air, the improvement comprising:

first electronic circuit means for controlling said current to said motor, said first circuit means including a first potentiometer having a shaft, wherein rotation of said first potentiometer shaft causes continuous variation of said current to said motor;

second electronic circuit means for controlling said current to said heater, said second circuit means including a second potentiometer having a shaft, wherein rotation of said second potentiometer shaft causes continuous variation of said current to said heater;

switch means for interrupting said current to said heater and said current to said motor;

a finger actuated trigger adjacent said handle and adapted to confront an index finger of said user holding said dryer, said trigger having a portion partially surrounding said index finger whereby said user is able to impart bidirectional motion to said trigger;

a gear mounted on said trigger;

a gear on said first potentiometer shaft; wherein movement of said trigger by said index finger causes said first potentiometer shaft to rotate, whereby said user is able to control said current to said motor by pulling said trigger;

a thumb wheel mounted on said second potentiometer shaft, said thumb wheel projecting behind said handle and positioned to allow said user holding said handle to turn said thumb wheel with the thumb, whereby said user is able to control said current to said heater by a movement of the thumb;

a cam element on said trigger an annular segment on said trigger, said annular segment smoothly adjoining said cam element; means activating said switch and confronting said cam element wherein movement of said trigger is transmitted to said activating means by said cam element and said annular segment; whereby a movement of said trigger to its forward most position causes said switch to interrupt said motor and heater current.

2. In a hand-held blower having a motor, a fan driven by said motor, means for providing electrical power to said motor, a heater, means for providing electrical power to said heater, a barrel, and a handle, wherein said electrical power to said motor causes said motor to drive said fan, causing a stream of air to flow through said barrel, wherein said electrical power to said heater causes said stream of air to be heated, and wherein a user holds said handle in a hand in order to direct said stream of air, the improvement comprising:

first electronic circuit means for continuously varying said electrical power provided to said motor;

second electronic circuit means for continuously varying said electrical power to said heater;

a finger actuated trigger adjacent to said handle and adapted to confront an index finger of said hand of said user holding said blower, said trigger having a portion at least partially surrounding said index finger to permit said user to impart bidirectional motion to said trigger with said index finger alone;

means coupling said trigger to said first electronic circuit means wherein movement of said trigger by said index finger causes variation of said electrical power to said motor, said means coupling said trigger to said first electronic circuit means being devoid of spring biasing means, thus permitting said trigger to retain a position once set;

switch means responsive to said finger actuated trigger for interrupting said electrical power to said heater element and said electrical power to said motor;

a thumb wheel having a projection proximate said handle and positioned to allow said user holding said handle to manipulate said thumb wheel with a thumb;

means coupling said thumb wheel to said second electronic circuit means wherein movement of said thumbwheel by said thumb causes continuous variation of said electrical power to said heater, said means coupling said thumbwheel to said second electronic circuit means being devoid of spring biasing means, thus permitting said thumbwheel to retain a position once set;

whereby said user is able to independently vary said electrical power to said motor and to said heater by use of said index finger and said thumb substantially without disturbing the position of remaining fingers on said hand holding said blower.

3. The invention of claim 2 also comprising:

a cam element on said trigger;

an annular segment on said trigger, said annular segment smoothly adjoining said cam element;

means coupled between said switch means and said cam element for activating said switch wherein movement of said trigger is transmitted to said switch activating means by said cam element and said annular segment;

whereby movement of said trigger to its forwardmost position causes said switch to interrupt said electrical power to said motor and said heater.

* * * * *